US012161272B2

(12) United States Patent
Li et al.

(10) Patent No.: US 12,161,272 B2
(45) Date of Patent: Dec. 10, 2024

(54) LIQUID CONTAINER, SMART CLEANING DEVICE AND SMART CLEANING SYSTEM

(71) Applicant: SHENZHEN ROCK TIMES TECHNOLOGY CO., LTD., Shenzhen (CN)

(72) Inventors: Xing Li, Shenzhen (CN); Song Peng, Shenzhen (CN); Chuanlin Duan, Shenzhen (CN); Youcheng Lu, Shenzhen (CN)

(73) Assignee: SHENZHEN ROCK TIMES TECHNOLOGY CO., LTD., Shenzhen (CN)

( * ) Notice: Subject to any disclaimer, the term of this patent is extended or adjusted under 35 U.S.C. 154(b) by 845 days.

(21) Appl. No.: 16/883,640

(22) Filed: May 26, 2020

(65) Prior Publication Data

US 2020/0288934 A1 Sep. 17, 2020

Related U.S. Application Data

(63) Continuation of application No. PCT/CN2018/105839, filed on Sep. 14, 2018.

(30) Foreign Application Priority Data

Sep. 25, 2017 (CN) ..... 201721239826.9

(51) Int. Cl.
*A47L 11/282* (2006.01)
*A47L 11/40* (2006.01)

(52) U.S. Cl.
CPC ..... *A47L 11/282* (2013.01); *A47L 11/4083* (2013.01); *A47L 11/4027* (2013.01); *A47L 2201/022* (2013.01)

(58) Field of Classification Search
CPC ..... A47L 11/282; A47L 11/4083; A47L 11/4027; A47L 2201/022; A47L 11/24; A47L 11/28; A47L 11/40
See application file for complete search history.

(56) References Cited

U.S. PATENT DOCUMENTS 8,898,844 B1 12/2014 Dooley et al.
2013/0116880 A1 5/2013 Shitamoto et al.
(Continued)

FOREIGN PATENT DOCUMENTS

CN 203693500 U 7/2014
CN 204931580 U 1/2016
CN 205306905 U 6/2016
(Continued)

OTHER PUBLICATIONS

CN Office Action for CN Application No. 201710876877.0, mailed on Mar. 22, 2021, 18 pages. Not translated.
(Continued)

*Primary Examiner* — David Redding
(74) *Attorney, Agent, or Firm* — Calfee, Halter & Griswold LLP

(57) ABSTRACT

In some examples, a liquid container is provided with a liquid outlet and an air inlet, the liquid outlet and the air inlet are disposed at a bottom of the liquid container, and the liquid container is shaped to facilitate air entered the liquid container through the air inlet to move to above a surface of liquid in the liquid container. In some examples, the liquid container is installable in a smartcleaning device and/or a smartcleaning system.

16 Claims, 6 Drawing Sheets

(56) References Cited

U.S. PATENT DOCUMENTS

| | | | |
|---|---|---|---|
| 2016/0070268 | A1 | 3/2016 | Ko |
| 2017/0072564 | A1 | 3/2017 | Cohen et al. |

FOREIGN PATENT DOCUMENTS

| | | | |
|---|---|---|---|
| CN | 106974597 | A | 7/2017 |
| CN | 206315047 | U | 7/2017 |
| CN | 107174169 | A | 9/2017 |
| JP | 2014232509 | A | 12/2014 |
| KR | 20060081514 | A | 7/2006 |

OTHER PUBLICATIONS

Extended European Search Report for EP Application 18858353.8, mailed on Mar. 25, 2021, 7 pages.

Extended European Search Report, dated Mar. 16, 2021 for European Application No. 18 85 8506, 10 pages.

English translation of International Search Report and Written Opinion received in PCT/CN2018/105839 dated Dec. 25, 2018.

LIQUID CONTAINER, SMART CLEANING DEVICE AND SMART CLEANING SYSTEM

CROSS-REFERENCE TO RELATED APPLICATION(S)

This application is a U.S. continuation application claiming priority to international Application No. PCT/CN2018/105839, filed Sep. 14, 2018, which is based upon and claims priority to Chinese Patent Application 201721239826.9, filed Sep. 25, 2017, the entire contents of which are incorporated herein by reference.

TECHNICAL FIELD

The present disclosure generally relates to the field of cleaning tools, and in particular, to a liquid container, a smart cleaning device, and a smart cleaning system.

BACKGROUND

An existing smart cleaning device that can provide a floor mopping function is usually provided with a liquid container. The lower part of the liquid container is provided with a liquid outlet. In addition, an upper part of the liquid container is provided with an air inlet to facilitate liquid output. The air inlet may be located in the upper part of the liquid container to connect air inside and outside the liquid container, so that air pressure in the liquid container is approximately equal to the atmospheric pressure. As a result, because the air pressure inside the liquid container is equal to the air pressure outside the liquid container, liquid constantly flows out of the liquid container under its own gravity, resulting in excessive liquid discharging. Excessive liquid discharging may lead to a poor cleaning effect, damage to the floor and components of the smart cleaning device, etc.

SUMMARY

Example embodiments are introduced in the SUMMARY section. These embodiments are further described in detail in the DESCRIPTION OF EMBODIMENTS section. The SUMMARY section of the present disclosure does not imply an attempt to define the key features and essential technical features of the claimed technical solutions, nor does it imply an attempt to determine the protection scope of the claimed technical solutions.

To resolve at least some of the foregoing technical issues, an aspect of the present disclosure provides a liquid container, where the liquid container is provided with a liquid outlet and an air inlet; the liquid outlet and the air inlet are disposed at a bottom of the liquid container, and the liquid container is shaped to facilitate air entered the liquid container through the air inlet moving to above a surface of liquid in the liquid container.

In an aspect of the present disclosure, the liquid container is shaped to make a space above the air inlet inside the liquid container be large.

In an aspect of the present disclosure, a distance between the air inlet and a top wall of the liquid container is greater than 4 mm.

In an aspect of the present disclosure, a radius of the air inlet ranges from 0.3 mm to 0.8 mm.

In an aspect of the present disclosure, the air inlet is frustoconical, and a radius of an upper end of the air inlet is smaller than a radius of a lower end of the air inlet.

In an aspect of the present disclosure, the air inlet includes an upper part, a middle part, and a lower part; the upper part and the lower part are cylindrical and the middle part connecting the upper part and the lower part is a frustoconical; where a radius of the upper part is smaller than a radius of the lower part.

In an aspect of the present disclosure, there are two liquid outlets, the two liquid outlets are placed at the same distance from the air inlet.

In an aspect of the present disclosure, a filer nozzle is disposed at the liquid outlet, and the filter nozzle is configured to adjust a liquid discharging rate.

In an aspect of the present disclosure, a cleaning cloth is attached to the bottom of the liquid container, and the cleaning cloth is configured to absorb liquid in the liquid container from the liquid outlet.

Another aspect of the present disclosure provides a smart cleaning device, including the liquid container described in any one of the foregoing solutions.

Still another aspect of the present disclosure provides a smart cleaning system, including:

the smart cleaning device described in the foregoing solution; and a charging station for charging the smart cleaning device.

BRIEF DESCRIPTION OF DRAWINGS

To make advantages of the present disclosure easier to understand, the following describes in more detail the disclosure with reference to specific embodiments shown in accompanying drawings. It can be understood that these accompanying drawings describe only typical embodiments of the present disclosure, and therefore should not be considered a limitation on the protection scope of the present disclosure. The present disclosure is described and explained based on appended features and details in the accompanying drawings.

DESCRIPTION OF EMBODIMENTS

The following discussion provides details to provide a more thorough understanding of the present disclosure. However, a person skilled in the art may understand that the present disclosure can be implemented without one or more of these details. In a particular example, to avoid confusion with the present disclosure, some technical features well known in the art are not described in detail.

Referring to FIG. 1 to FIG. 5, the embodiments of the present disclosure provide a smart cleaning system. The smart cleaning system includes a smart cleaning device and a charging station for charging the smart cleaning device. The smart cleaning device may move and clean a surface. The charging station is configured to charge the smart cleaning device. The charging station is usually placed at a fixed position on the surface, such as a position near a wall or a corner. The smart cleaning device can move to the charging place at the charging station. When the smart cleaning device is located at the charging place, the smart cleaning device is charged by the charging station.

Figure 1:
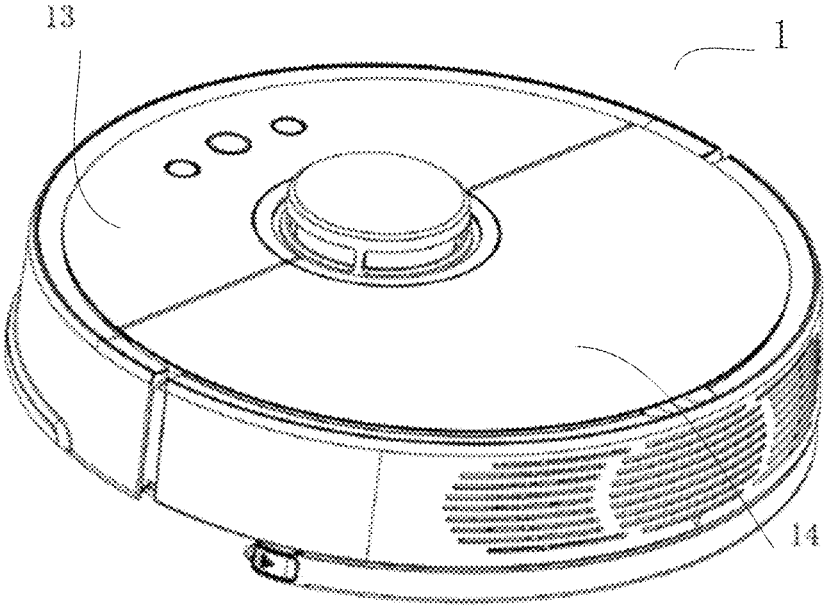
FIG. 1 is a schematic three-dimensional diagram of a smart cleaning device of a smart cleaning system according to an optional embodiment of the present disclosure.
Figure 2:
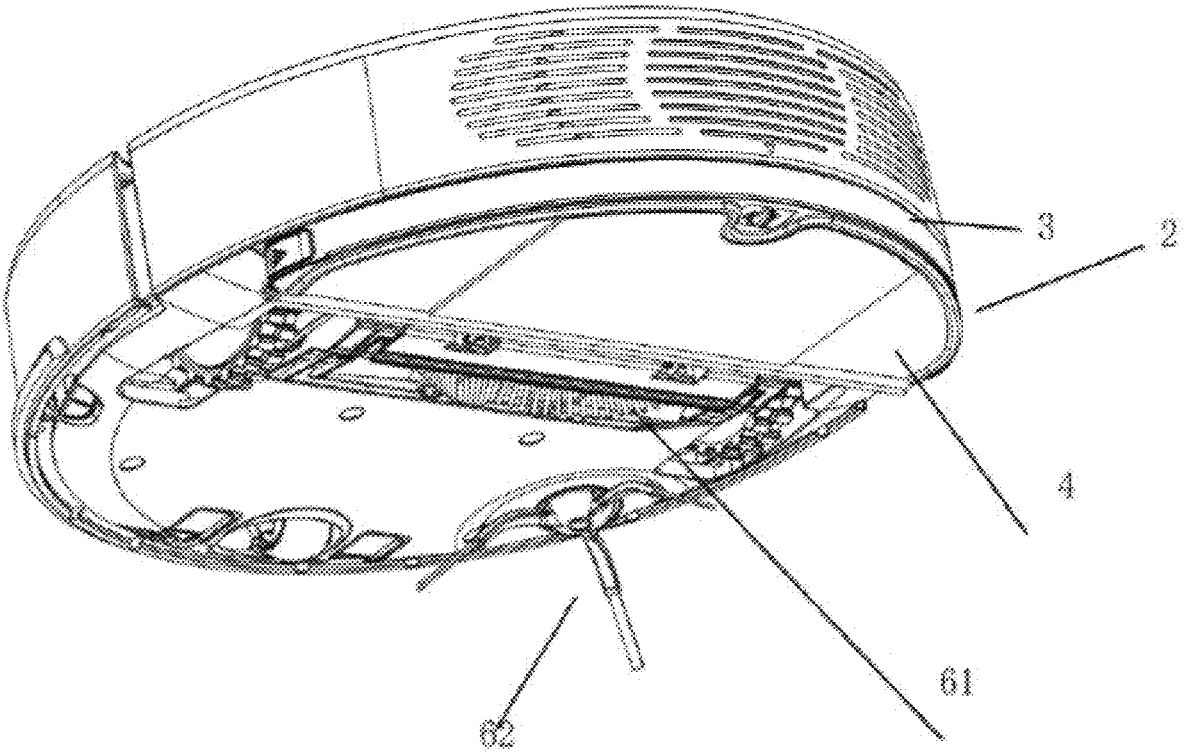
FIG. 2 is another schematic three-dimensional diagram of the smart cleaning device in FIG.
Figure 3:
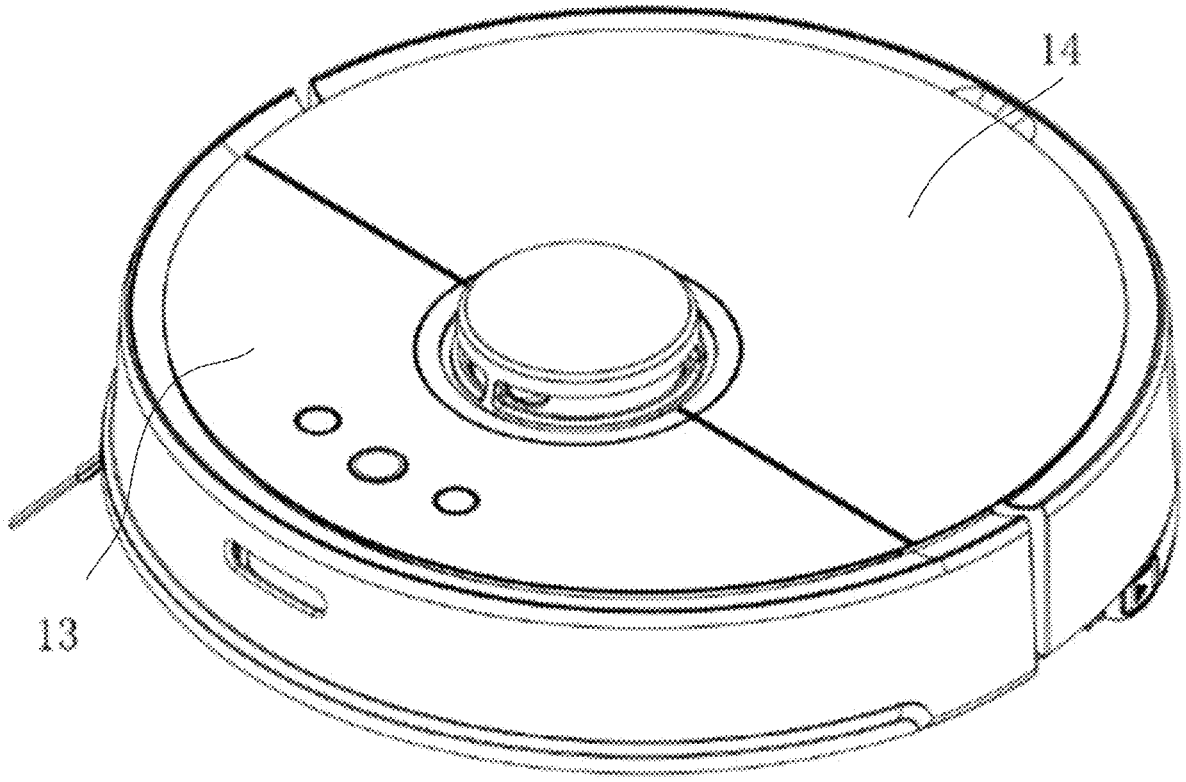
FIG. 3 is another schematic three-dimensional diagram of the smart cleaning device in FIG. 1.

FIG. 1 and FIG. 2 are schematic structural diagrams of a smart cleaning device (such as an autonomous cleaning robot) according to an example embodiment. In addition to a machine body 1 and a cleaning system, the smart cleaning device may include a sensing system, a control system (not shown in the figures), a driving system, a power system, and a human-machine interaction system. The following describes the main parts of the smart cleaning device in detail.

The machine body 1 includes an upper cover, a front portion 13, a rear portion 14, a chassis, and the like. The machine body 1 is in an approximate circular shape (both the front portion and the rear portion are circular) or may be in other shapes, including but not limited to the approximate D-shape, that is, the front portion is rectangle and the rear portion is circular.

The sensing system may include several sensing apparatuses, such as a position determining apparatus disposed above the machine body 1, a bumper disposed on the front portion 13 of the machine body 1, a cliff sensor, an ultrasonic sensor, an infrared sensor, a magnetometer, an accelerometer, a gyroscope, and an odometer. These sensing apparatuses provide various position information and motion state information of the machine for the control system. The position determining apparatus includes but is not limited to an infrared emitting and receiving apparatus, a camera, and a laser distance sensor (LDS).

The cleaning system may include a dry cleaning unit and a wet cleaning unit. The wet cleaning unit is a first cleaning unit 2, and it is able to wipe a surface (such as a floor) by using a cleaning cloth 4 that is wetted by cleaning liquid. The dry cleaning unit is a second cleaning unit, and it able to remove debris from the surface by using a cleaning head, such as a cleaning brush.

The second cleaning unit may include a rolling brush 61, a dust container, a fan, a ventilation outlet, and connecting parts among the above four parts. The rolling brush 61 interfered with the surface sweeps debris on the floor and brings it to the front of a dust suction port between the rolling brush 61 and the dust container, and then the debris is conveyed into the dust container by an air suction stream generated by the fan and passing through the dust container. The dedusting capability of a cleaning machine can be represented by dust pick up efficiency (DPU). The DPU is affected by the structure and material of the rolling brush 61, wind power utilization of an air duct made up of the dust suction port, the dust container, the fan, the ventilation outlet, and the connecting parts among the four parts, and by a type and power of the fan. Compared with the conventional cleaner, a high dedusting capability is more important for autonomous cleaning robots. The energy requirement by the cleaning robot may be reduced by a high dedusting capability. For example, a robot that can clean 80 square meters of the surface with a single charge can be improved to clean 100 or more square meters of the surface. In addition, as charging times decrease, a service life of a battery may increase. Consequently, the frequency of replacing the battery decreases. The dedusting capability is an important user experience, for a user can sense whether a surface is clean after operation by a cleaning robot. The dry cleaning system may further include a side cleaning head 62 having a rotation shaft. The rotation shaft is disposed at an angle relative to the floor, so as to move debris into a cleaning region of the rolling brush 61 of the second cleaning unit.

The first cleaning unit 2 may include a liquid container 3, a cleaning cloth 4, and the like. The liquid container 3 may serve as a basis for carrying other parts of the first cleaning unit 2. The cleaning cloth 4 is detachably disposed on the liquid container 3. The liquid inside the liquid container 3 flows to the cleaning cloth 4 to facilitate the cleaning cloth 4 wiping a surface.

The driving system is configured to drive the cleaning robot to implement automatic moving and cleaning. The driving system includes a driving wheel module. The driving system may send a driving command to control the robot to move across the surface, based on distance and angle information such as components x, y, and θ. The driving wheel module can control a left wheel and a right wheel simultaneously. To control the movement of the machine more accurately, the driving wheel module preferably includes a left driving wheel module and a right driving wheel module. The left and right driving wheel modules are symmetrically disposed along a lateral axis that is defined by the machine body 1. To improve the motion stability and motion ability of the cleaning robot, the robot may include one or more driven wheels, and the driven wheels include but are not limited to casters.

The driving wheel module includes a wheel, a driving motor, and a control circuit for controlling the driving motor. The driving wheel module may connect to an odometer and a circuit for measuring a drive current. The driving wheel module may be detachably connected to the machine body 1 to facilitate assembly, disassembly, and maintenance. The driving wheel may have a biased-to-drop suspension system that is secured in a movable manner. For example, the suspension system is rotately attached to the machine body 1, and receives a spring bias that is offset downward and away from the machine body 1. The spring bias allows the driving wheel to maintain contact and traction with the floor by using a specific touchdown force, and the cleaning element (such as the rolling brush) of the robot is also in contact with the floor with a specific pressure.

The forward portion 13 of the machine body 1 may carry a bumper. When the driving wheel module drives the robot to traverse on the floor during cleaning, the bumper detects one or more events in the traveling route of the robot by using a sensor system, such as an infrared sensor. Based on the events detected by the bumper, such as obstacles and walls, the robot can control the driving wheel module to enable the robot to respond to the events, for example, keep away from the obstacles.

The control system is provided on the main circuit board in the machine body 1. The control system may include anon-transitory memory, a computing processor, etc. the non-transitory memory may include a hard disk, a flash memory, or a random access memory. The computing processor may include a central processing unit and an application processor. The application processor generates, based on obstacle information fed back by a laser distance sensor and by using a positioning algorithm such as SLAM, an instant map of an environment in which the robot is located. Combining with distance information and velocity information sent by sensing apparatuses such as the bumper, the cliff sensor 51, the ultrasonic sensor, the infrared sensor, the magnetometer, the accelerometer, the gyroscope, and the odometer, a current working status of the cleaning robot is determined. For example, the control system may determine whether the cleaning robot cross a threshold, moves on a carpet, reaches a cliff, is stuck, or is picked up. In addition, the control system may determine whether the dust container is full. The control system may provide different next action strategies based on different situations, so that to make the robot meet the user's requirements and deliver better user experience. Furthermore, the control system may plan an efficient and reasonable cleaning route and cleaning manner based on information about the instant map that is drawn based on SLAM, thereby improving the cleaning efficiency of the robot.

The power system includes a rechargeable battery, for example, a NiMH batteries or a lithium battery. The rechargeable battery may be connected to a charging control circuit, a battery pack temperature detection circuit, and a battery undervoltage monitoring circuit. The charging control circuit, the battery pack temperature detection circuit, and the battery undervoltage monitoring circuit may be connected to a single-chip microcomputer control circuit. The robot is charged by connecting a charging electrode disposed on a side or a lower part of the machine body to the charging station.

The human-machine interaction system may include buttons on a panel of the robot, which are used by the user to select functions. The human-machine interaction system 9 may further include a display screen, an indicator, and/or a speaker, which show the current status of the robot or function options for the user. The human-machine interaction system 9 may further include a mobile client application. For a route-navigated cleaning device, the mobile client application can show the user a map of the environment in which the robot is located, as well as the location of the robot, thereby providing the user with more abundant and user-friendly function options.

To describe behavior of the robot more clearly, the following describes definitions of directions. The robot may travel on the surface based on various combinations of movements relative to the following three mutually perpendicular axes defined by the machine body 1: the front-back axis X (that is, the axis along the direction of the forward portion 13 and the backward portion 14 of the machine body 1), the lateral axis Y (that is, the axis perpendicular to the axis X and located on the same horizontal plane as the axis X), and the central vertical axis Z (the axis perpendicular to the plane formed by the axis X and the axis Y). The forward driving direction along the front-back axis X is marked as "forward", and the backward driving direction along the front-back axis X is marked as "backward". The lateral axis Y essentially extends between the right and left wheels of the robot along an axial center defined by the center point of the driving wheel module.

The robot can rotate around the axis Y. When the forward portion of the robot is tilted upward and the backward portion is tilted downward, "pitchup" is defined. When the forward portion of the robot is tilted downward and the backward portion is tilted upward, "pitchdown" is defined. In addition, the robot can rotate around the axis Z. In the forward direction of the robot, when the robot tilts to the right of the axis X, "right turn" is defined; and when the robot tilts to the left of the axis X, "left turn" is defined.

The dust container may be mounted in a receptacle by means of buckle and handle. When the handle is clamped, a clamping part withdraws. When the handle is released, the clamping part protrudes out and is clamped in a recess for holding the clamping part n the receptacle.

Figure 4:
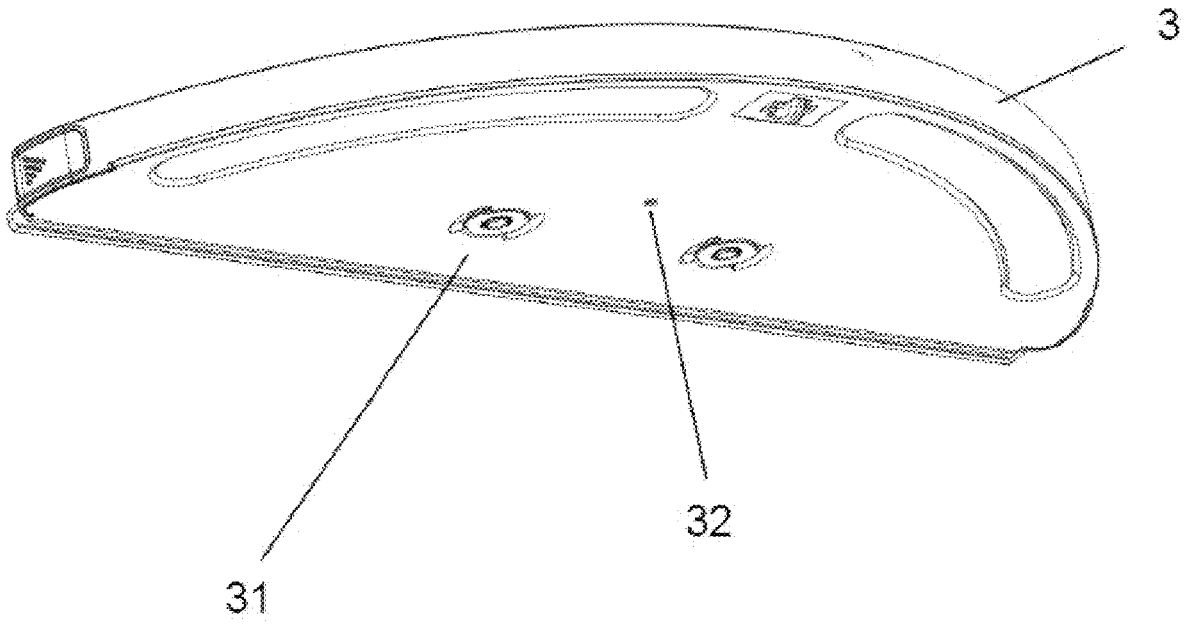
FIG. 4 is a schematic bottom view of a liquid container of the smart cleaning device in FIG. 1.

FIG. 4 illustrates a liquid container 3 according to an embodiment of the present disclosure. As can be seen from FIG. 4, the dimension of the liquid container 3 in the horizontal direction is larger than the dimension of the liquid container 3 in the vertical direction. In a top view, the liquid container 3 has an approximately semicircular structure (that is, the "D"-shaped structure described above). It should be noted that the extension direction or dimension direction (e.g., "vertical", "horizontal", "upper", and "lower") of each part described in the present disclosure are the extension direction and dimension direction when the smart cleaning device is located on the horizontal surface.

According to an embodiment of the present disclosure, the bottom 33 of the liquid container 3 may be provided with a liquid outlet 31 for outputting liquid from the liquid container 3 and an air inlet 32 through which air enters the liquid container 3. As illustrated in FIG. 4, two liquid outlets 31 and an air inlet 32 are provided. The two liquid outlets 31 may be approximately and symmetrically disposed relative to a symmetry axis of the bottom surface of the liquid container 3. A filter nozzle may be installed at the liquid outlet 31, and the filter nozzle is configured to adjust a liquid discharging rate.

Theoretically, in case that the air inlet 32 is disposed at the bottom of the liquid container 3, the air outside the liquid container 3 and the air inside the liquid container 3 are separated by liquid in the liquid container 3. Therefore, the air inside and outside the liquid container 3 are not connected to each other. However, the air outside the liquid container 3 can enter the liquid container 3 from the air inlet 32 when the pressure at the air inlet 32 in the liquid container 3 is lower than the atmospheric pressure.

Specifically, the liquid container 3 is constructed to be capable of maintaining equal internal and external pressure at the liquid outlet 31 when no external force is exerted on the liquid outlet 31. To be specific, without external force, the internal and external pressure at the liquid outlet 31 of the liquid container 3 approximately meets the following equation:

$$P_1+\rho gh=P,$$

where $P_1$ represents the air pressure inside the liquid container 3, ρ represents density of the liquid in the liquid container 3, h represents a height of the liquid in the liquid container 3, and P represents the atmospheric pressure.

It should be noted that the foregoing equation is only used to schematically describe an equilibrium state at the liquid outlet 31 of the liquid container 3 without external force. In practice, there may be other factors that affect the equilibrium of the liquid container 3. For example, when the internal pressure at the liquid outlet 31 is slightly greater than the external pressure and the liquid tends to move outward, a friction is generated between the liquid outlet 31 and the liquid, which inhibits the liquid from moving outward the liquid container 3. Further, in addition to gravity and gas pressure, the surface tension of the liquid may affect the movement of the liquid. For example, liquid needs to overcome its surface tension when starting to move.

Generally, without external force, the pressure at the liquid outlet 31 in the liquid container 3 is equal to the pressure at the air inlet 32.

Additionally, and/or alternatively, a cleaning cloth 4 is attached to the lower surface of the liquid container 3, and the cleaning cloth 4 is in contact with the filter nozzle at the liquid outlet 31. The cleaning cloth 4 has water absorption, and is configured to absorb the liquid in the container from the liquid outlet 31. Therefore, when the pressure inside the liquid outlet 31 is equal to the pressure outside the liquid outlet 31, the liquid is flowed from the liquid outlet 31 under the absorption by the cleaning cloth 4. The volume of the air in the liquid container 3 creases with the liquid flows outward the liquid container 3, and consequently the air pressure in the liquid container 3 decreases (which is derived from formula pV=nRT). In addition, as the liquid height h decreases, the liquid pressure ρgh at the air inlet 32 decreases accordingly. In this case, the atmospheric pressure is greater than the pressure at the air inlet 32 in the liquid container 3, and consequently air enters the liquid container 3 from the air inlet 32. As a result, the internal and external pressure at the air inlet 32 and the liquid outlet 31 of the liquid container 3 reaches equilibrium again.

When the pressure inside the liquid container 3 and the pressure outside the liquid container 3 reaches equilibrium, air cannot enter the liquid container 3 from the air inlet 32. After the cleaning cloth 4 absorbs water from the liquid outlet 31 again, the equilibrium is broken again, and air can enter the liquid container 3 again from the air inlet 32.

Additionally, and/or alternatively, when the smart cleaning device is located on a flat surface, the surface and the cleaning cloth 4 slightly interfere with each other, so that the surface is pressed upward against the cleaning cloth 4, and the cleaning cloth 4 absorbs the liquid from the liquid container 3 continually, to make the liquid flow from the liquid outlet 31 constantly.

The air inlet 32 is optionally disposed away from the sidewall of the liquid container 3. In an embodiment of the present disclosure, the air inlet 32 is disposed at the lateral or longitudinal axis of the bottom 33 of the liquid container 3. If there are two liquid outlets 31 are provided on the liquid container, the air inlet 32 may be spaced equally away from the two liquid outlets 31, so that the liquid discharging rates of the two liquid outlets 31 are as equal as possible.

Figure 5:
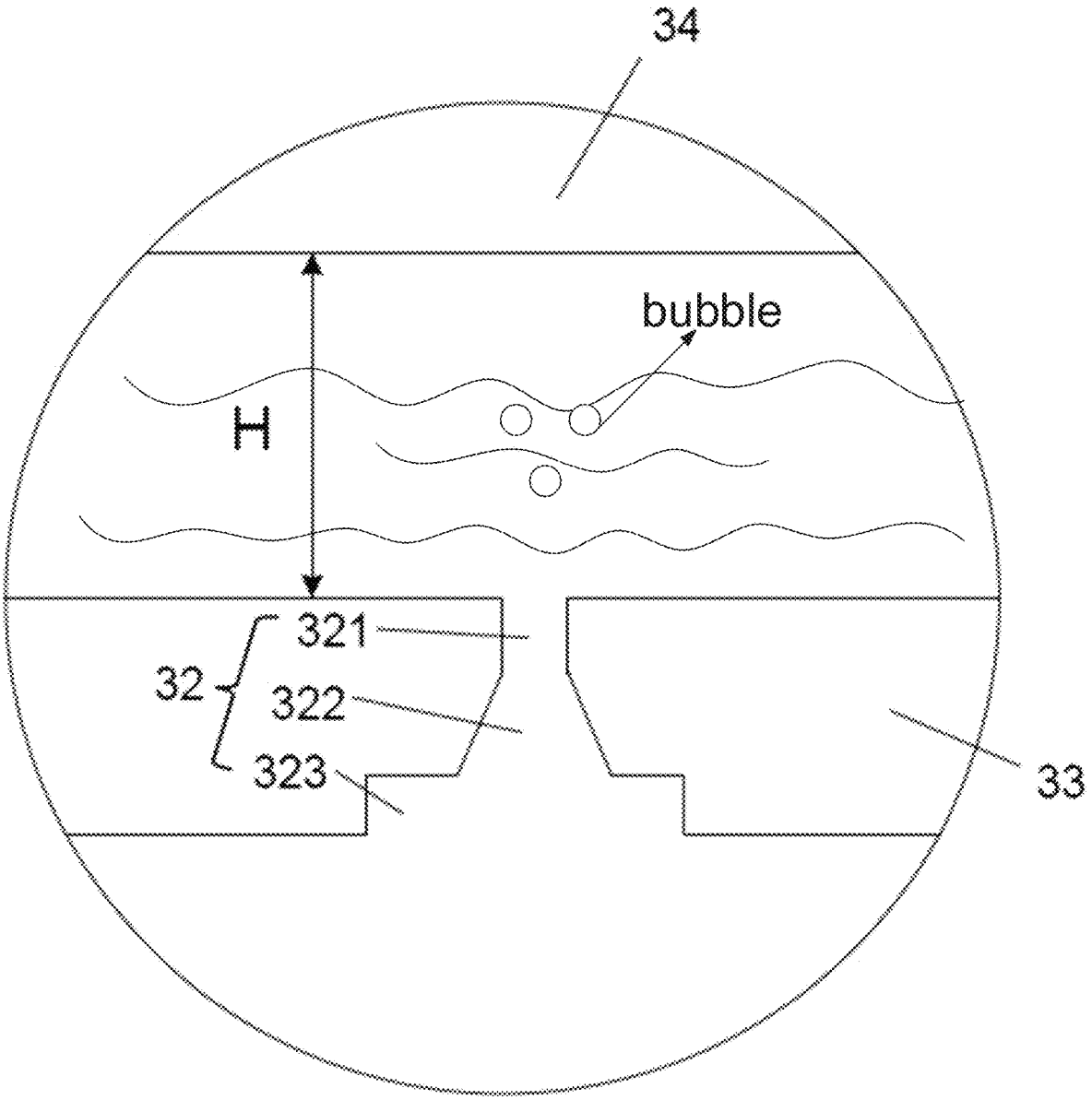
FIG. 5 is a schematic cross-sectional diagram of an air inlet of the liquid container in FIG. 4.

The air inlet 32 penetrates the bottom 33 of the liquid container 3, and its shape may be shown in FIG. 5. The air inlet 32 includes an upper part 321, a middle part 322, and a lower part 323. The upper part 321 is approximately a cylindrical structure. The middle part 322 is formed as a truncated cone with a smaller radius at the top and a larger radius at the bottom. The lower part 323 also is a cylindrical structure, and as can be seen from the figure, the radius of the lower part 323 is larger than the radiuses of the middle part 322 and the upper part 321.

The structure of the air inlet 32 that, the bottom of the air inlet 32 has a large radius, and the radius decreases from the bottom up, can guide the movement of the air, to facilitate sucking the air when the pressure inside the air inlet 32 is lower than the pressure outside the air inlet 32. In some examples, the radius of the upper part 321 of the liquid outlet 31 may range from 0.3 mm to 0.8 mm. It should be noted that the "radius of the air inlet" described in the present disclosure is the radius at the top of the air inlet.

Figure 6:
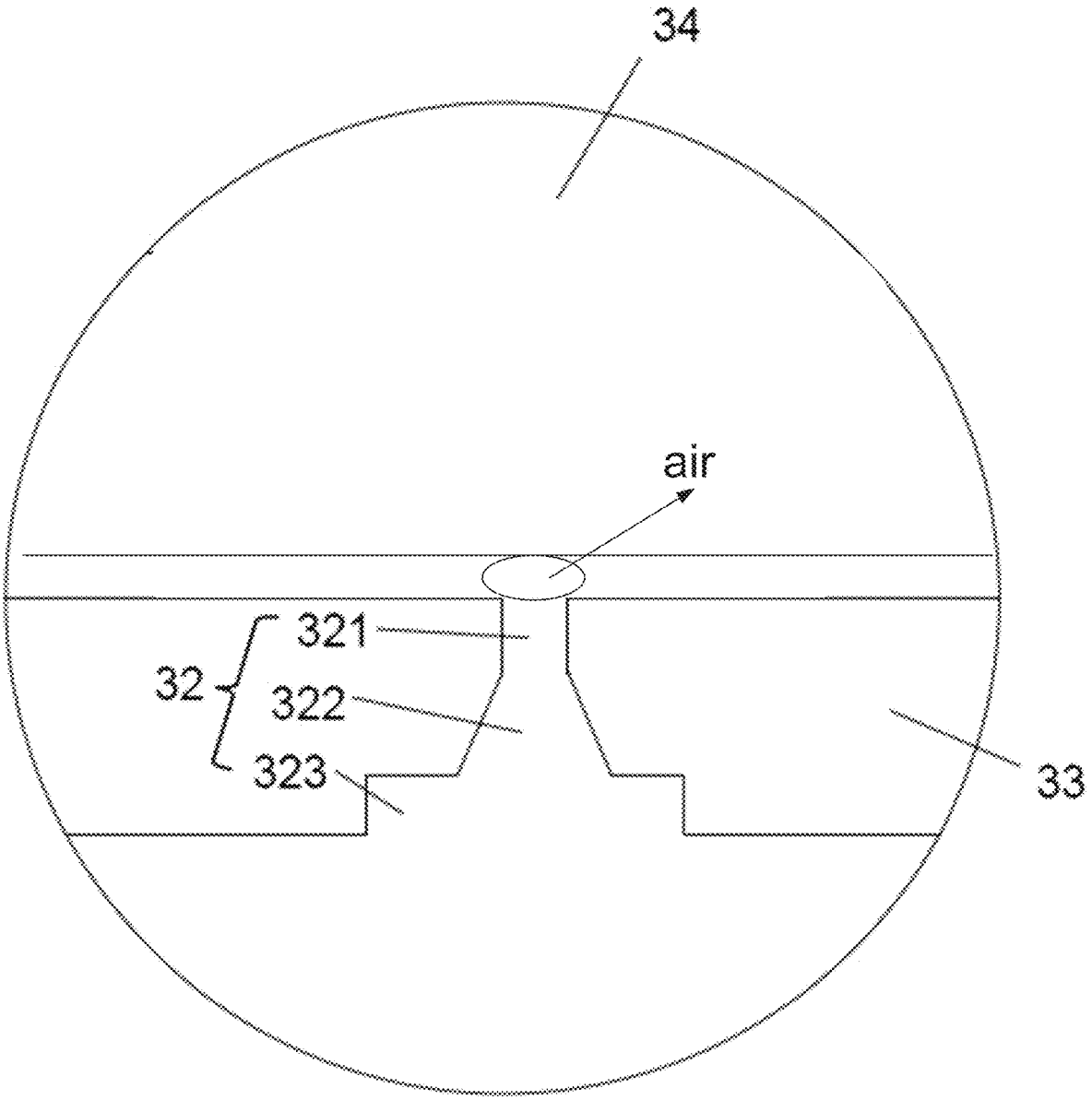
FIG. 6 is a schematic showing air travel at an air inlet.

To ensure that the air smoothly reaches above the surface of the liquid in the liquid container 3 after entering the liquid container 3 from the air inlet 32, no block is disposed in the space above the air inlet 32. That is, the space above the air inlet 32 in the liquid container 3 is sufficiently wide. Therefore, there is no need to set an additional function (such as a vibration function) of preventing bubbles from gathering near the air inlet for the smart cleaning device. Air can also smoothly rise to the space above the surface of the liquid in the liquid container 3, thus quickly changing the pressure inside the liquid container 3. In some examples, the distance between the air inlet 32 and the top wall 34 of the liquid container 3 (i.e., the distance H between the lower surface of the top wall 34 and the upper surface of the bottom wall 33) is greater than 4 mm, thereby further ensuring enough space for bubbles to move. Conversely, if the space above the air inlet 32 in the liquid container 3 is not sufficiently wide, for example, if the distance between the lower surface of the top wall 34 and the upper surface of the bottom wall 33 is too small (see FIG. 6), it is difficult for air entered the liquid container 3 from the air inlet 32 to form a bubble in the small space and leave the air inlet 32, and consequently the air will be jammed at the air inlet 32.

According to the smart cleaning device provided by an embodiment of the present disclosure, the air inlet 32 of the liquid container 3 may be disposed at the bottom of the liquid container 3. In this case, the air pressure in the liquid container 3 is lower than the atmospheric pressure, and the pressure inside the liquid outlet 31 is equal to the pressure outside the liquid outlet 31 (the pressure inside the liquid outlet 31 is the sum of the liquid pressure and the air pressure, and the pressure outside the liquid outlet 31 is the atmospheric pressure). And the liquid is output under the absorption of the cleaning cloth 4. In this way, the liquid discharging amount is effectively controlled, which brings achieve an improved cleaning effect, and prevent damage to the floor or components due to excessive liquid discharging. Furthermore, the space above the air inlet 32 is wide, to make the air smoothly move to the space above the liquid. This prevents the air from gathering at the air inlet 32, thus effectively adjusting the air pressure in the liquid container 3, and further ensuring that the liquid can be discharged smoothly from the liquid outlet 31.

Unless otherwise defined, the technical and scientific terms used in the present disclosure have the same meanings as those commonly understood by a person skilled in the art of the present disclosure. The terms used in the present disclosure are merely for the purpose of describing specific implementation, and are not intended to limit the present disclosure. Terms such as "part" that appear in the present disclosure may represent either a single part or a combination of multiple parts. Terms such as "install" and "dispose" that appear in the present disclosure may indicate that one part is attached directly to another part, or may indicate that one part is attached to another part by using an intermediate part. In the present disclosure, a feature described in one embodiment may be applied to another embodiment individually or in combination with other features, unless the feature is not applicable or otherwise stated in the another embodiment.

The present disclosure has been described by using the foregoing embodiments, but it should be understood that the foregoing embodiments are used only for the purposes of illustration and description, and are not intended to limit the present disclosure to the scope of the described embodiments.

What is claimed is:

1. A liquid container for a smart cleaning device comprising:

two liquid outlets and an air inlet each disposed at a bottom of the liquid container, wherein the liquid container is shaped to facilitate air entered the liquid container through the air inlet to move to above a surface of liquid in the liquid container; and wherein a distance between the air inlet and a top wall of the liquid container is sufficiently large to cause, without additional vibration, air entered the liquid container through the air inlet to form one or more bubbles that continuously travel to reach the surface of the liquid in the liquid container without blocking the air inlet;

wherein the air inlet is disposed at a front-back axis of the bottom of the liquid container, the two liquid outlets are symmetrically disposed relative to a symmetry axis of the bottom of the liquid container and placed at a same distance from the air inlet;

wherein the air inlet comprises an upper part, a middle part, and a lower part;

wherein the upper part and the lower part are cylindrical and the middle part connecting the upper part and the lower part is a frustoconical;

wherein a radius of the upper part is smaller than a radius of the lower part.

2. The liquid container of claim 1, wherein the liquid container is shaped to make that there is no block in a space above the air inlet inside the liquid container.

3. The liquid container of claim 1, wherein the distance between the air inlet and the top wall of the liquid container is greater than 4 mm.

4. The liquid container of claim 1, wherein a radius of the air inlet ranges from 0.3 mm to 0.8 mm.

5. The liquid container of claim 1, wherein a filer nozzle is disposed at each of the liquid outlets, and the filter nozzle is configured to adjust a liquid discharging rate.

6. The liquid container of claim 1, wherein a cleaning cloth is attached to the bottom of the liquid container, and the cleaning cloth is configured to absorb liquid in the liquid container from each of the liquid outlets.

7. A smart cleaning device, comprising a liquid container;

wherein the liquid container is provided with two liquid outlets and an air inlet;

wherein the liquid outlet and the air inlet are disposed at a bottom of the liquid container, and the liquid container is shaped to facilitate air entered the liquid container through the air inlet to move to above a surface of liquid in the liquid container; and wherein a distance between the air inlet and a top wall of the liquid container is sufficiently large to cause, without additional vibration, air entered the liquid container through the air inlet to form one or more bubbles that continuously travel to reach the surface of the liquid in the liquid container without blocking the air inlet;

wherein the air inlet is disposed at a front-back axis of the bottom of the liquid container, the two liquid outlets are symmetrically disposed relative to a symmetry axis of the bottom of the liquid container and placed at a same distance from the air inlet;

wherein the air inlet comprises an upper part, a middle part, and a lower part;

wherein the upper part and the lower part are cylindrical and the middle part connecting the upper part and the lower part is a frustoconical;

wherein a radius of the upper part is smaller than a radius of the lower part.

8. The smart cleaning device of claim 7, wherein the liquid container is shaped to make that there is no block in a space above the air inlet inside the liquid container.

9. The smart cleaning device of claim 7, wherein the distance between the air inlet and the top wall of the liquid container is greater than 4 mm.

10. The smart cleaning device of claim 7, wherein a radius of the air inlet ranges from 0.3 mm to 0.8 mm.

11. The smart cleaning device of claim 7, wherein a filer nozzle is disposed at each of the liquid outlets, and the filter nozzle is configured to adjust a liquid discharging rate.

12. The smart cleaning device of claim 7, wherein a cleaning cloth is attached to the bottom of the liquid container, and the cleaning cloth is configured to absorb liquid in the liquid container from each of the liquid outlets.

13. A smart cleaning system, comprising:

a smart cleaning device; and a charging station, wherein the smart cleaning device is configured to be charged by the charging station;

wherein the smart cleaning device comprises a liquid container;

wherein the liquid container is provided with two liquid outlets and an air inlet;

wherein the liquid outlet and the air inlet are disposed at a bottom of the liquid container, and the liquid container is shaped to facilitate air entered the liquid container through the air inlet to move to above a surface of liquid in the liquid container; and wherein a distance between the air inlet and a top wall of the liquid container is sufficiently large to cause, without additional vibration, air entered the liquid container through the air inlet to form one or more bubbles that continuously travel to reach the surface of the liquid in the liquid container without blocking the air inlet;

wherein the air inlet is disposed at a front-back axis of the bottom of the liquid container, the two liquid outlets are symmetrically disposed relative to a symmetry axis of the bottom of the liquid container and placed at a same distance from the air inlet;

wherein the air inlet comprises an upper part, a middle part, and a lower part;

wherein the upper part and the lower part are cylindrical and the middle part connecting the upper part and the lower part is a frustoconical;

wherein a radius of the upper part is smaller than a radius of the lower part.

14. The system of claim 13, wherein the liquid container is shaped to make that there is no block in a space above the air inlet inside the liquid container.

15. The system of claim 13, wherein the distance between the air inlet and the top wall of the liquid container is greater than 4 mm.

16. The system of claim 13, wherein a radius of the air inlet ranges from 0.3 mm to 0.8 mm.

* * * * *